US005557650A

United States Patent [19]

Guida et al.

[11] Patent Number: 5,557,650

[45] Date of Patent: Sep. 17, 1996

[54] METHOD FOR FABRICATING AN ANTI-SCATTER X-RAY GRID DEVICE FOR MEDICAL DIAGNOSTIC RADIOGRAPHY

[75] Inventors: Renato Guida, Wynantskill; Kenneth P. Zarnoch, Scotia, both of N.Y.

[73] Assignee: General Electric Company, Schenectady, N.Y.

[21] Appl. No.: 402,222

[22] Filed: Mar. 10, 1995

[51] Int. Cl.[6] ..... G21K 1/00

[52] U.S. Cl. ..... 378/154; 378/147

[58] Field of Search ..... 378/154, 145, 378/147

[56] References Cited

U.S. PATENT DOCUMENTS 2,605,427 11/1949 Delhumeau .

5,418,833 5/1995 Logan ..... 378/154

*Primary Examiner*—Don Wong

*Attorney, Agent, or Firm*—Ann M. Agosti; Marvin Snyder

[57] ABSTRACT

A method for fabricating an anti-scatter x-ray grid for medical diagnostic radiography includes providing a substrate having channels therein and material that is substantially non-absorbent of x-radiation; and filling the channels with absorbing material that is substantially absorbent of x-radiation. In one embodiment, the step of providing a substrate having channels therein comprises sawing a plastic substrate with a thin circular blade and the step of filling the channels with absorbing material comprises melting the absorbing material and flowing the melted absorbing material into the channels.

17 Claims, 3 Drawing Sheets fig. 3
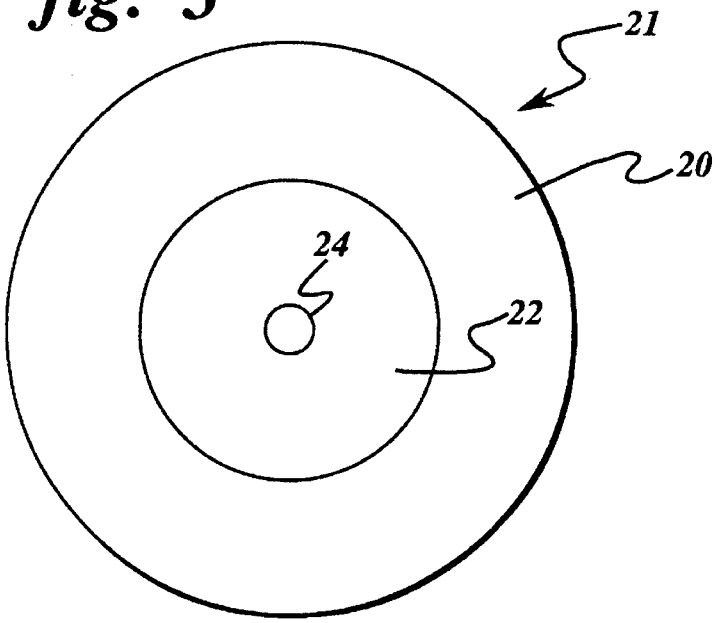
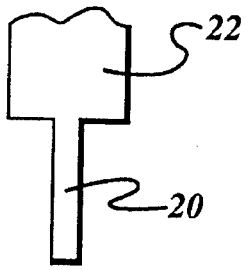
fig. 4
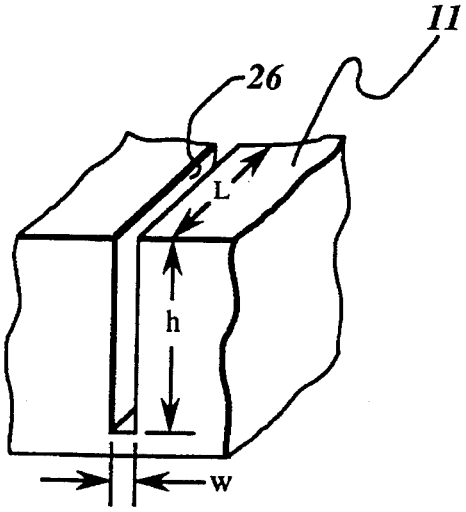
fig. 5
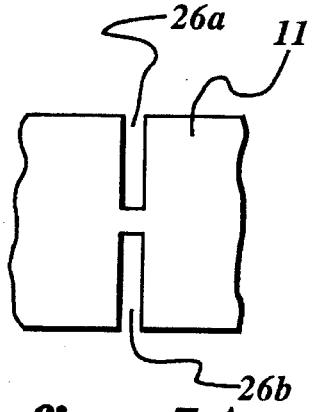
fig. 5A
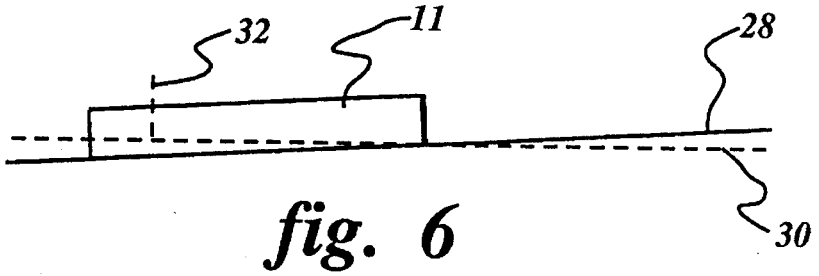
fig. 6

METHOD FOR FABRICATING AN ANTI-SCATTER X-RAY GRID DEVICE FOR MEDICAL DIAGNOSTIC RADIOGRAPHY

CROSS-REFERENCE TO RELATED APPLICATION

This application is related to the following copending application which is commonly assigned and is incorporated herein by reference: K. P. Zarnoch et al., "Antiscatter X-ray Grid Device for Medical Diagnostic Radiography," U.S. Application Ser. No. (attorney docket number RD-24,118), filed concurrently herewith.

BACKGROUND OF THE INVENTION

1. Field of the Invention

The present invention relates generally to the field of diagnostic radiography and, more particularly, to a method for fabricating an anti-scatter grid capable of yielding high resolution, high contrast radiographic images.

2. Description of the Related Art

During medical diagnostic radiography processes, x-radiation impinges upon a patient. Some of the x-radiation becomes absorbed by the patient's body, and the remainder of the x-radiation penetrates through the body. The differential absorption of the x-radiation permits the formation of a radiographic image on a photosensitive film.

Of the x-rays that pass through the body, primary radiation travels unimpeded and directly along the path from which the x-rays were originally emitted from the source. Scattered radiation is that which passes through the body, is scattered by the body elements, and thus travels at an angle from the original path. Both primary and scattered radiation will expose a photosensitive film, but scattered radiation, by nature of its trajectory, reduces the contrast (sharpness) of the projected image. In conventional posterior/anterior chest x-ray examinations, for example, about sixty percent of the radiation that penetrates through the body can be in the form of scattered radiation and thus impart a significant loss of image contrast. Therefore, it is desirable to filter out as much of the scattered radiation as possible.

One embodiment for filtering scattered radiation includes an anti-scatter grid which is interposed between the body and the photosensitive film. Scattered radiation impinges upon absorbent (opaque) material in the grid and becomes absorbed. Also absorbed by the absorbing material, however, is a portion of the primary radiation. The radiographic imaging arrangement of this embodiment provides higher contrast radiographs by virtue of the elimination of the scattered radiation, but necessitates an increase in radiation dosage to the patient in order to properly expose the photographic element. The increased radiation requirement results in part because the scattered radiation no longer constitutes part of the imaging x-ray beam, and in part because as much as 30% or more of the primary beam impinges upon the absorbing material in the grid and itself becomes filtered out (i.e. absorbed).

The increased radiation required for the exposure can be a factor of seven (7) or more, i.e., the patient can receive seven times the x-radiation dose when the grid is used as a part of the radiographic system. Because high doses of x-radiation pose a health hazard to the exposed individual, there has been a continual need to reduce the amount of x-radiation a patient receives during the course of a radiographic examination.

Many conventional grids use thin lead strips as the x-ray absorber and either aluminum strips or fiber composite strips as transparent interspace material. Conventional manufacturing processes consist of tediously laminating individual strips of the absorber material and non-absorber interspace material by laboriously gluing together alternate layers of the strips until thousands of such alternating layers comprise a stack. Furthermore, to fabricate a focused grid, the individual layers must be placed in a precise manner so as to position them at a slight angle to each other such that each layer is fixedly focused to a convergent line: the x-ray source. After the composite of strips is assembled into a stack, it must then be cut and carefully machined along its major faces to the required grid thickness that may be as thin as only 0.5 millimeters, the fragile composite then being, for example, 40 cm by 40 cm by 0.5 mm in dimension and very difficult to handle. If the stack has survived the machining and handling processes, the stack must further be laminated with sufficiently strong materials so as to reinforce the fragile grid assembly and provide enough mechanical strength for use in the field. Accidental banging, bending, or dropping of such grids can cause internal damage, i.e., delamination of the layers which cannot be repaired, rendering the grid completely useless.

A significant parameter in the grid design is the grid ratio, which is defined as the ratio between the height of the x-ray absorbing strips and the distance between them. The ratios typically range from 4:1 to 16:1. Because a value of about 0.050 mm lead thickness is a practical lower limit imposed by current manufacturing limitations, i.e., it being extremely difficult to handle strips at this thickness or thinner, a grid with a ratio of 4:1 with a line rate of 60 lines per centimeter demands that the interspace material be 0.12 mm in thickness and results in a grid that is only 0.5 mm thick. Because of the manufacturing limitations, the lead strips in these grids are generally too wide and, consequently, yield a large cross-sectional area that undesirably absorbs as much as 30% or more of the primary radiation. Furthermore, the thick strips result in an undesirable shadow-image cast onto the film. To obliterate the shadows, it becomes necessary to provide a mechanical means for moving the grid during the exposure period. This motion of the grid causes lateral decentering and can consequently result in absorption of an additional 20% of the primary radiation. Thus the use of wide absorber strips requires a significant increase in patient dosage to compensate this drawback.

SUMMARY OF THE INVENTION

Accordingly, an object of an embodiment of the invention is to provide an efficient method for fabricating a robust anti-scatter grid.

Another object of an embodiment of the invention is to provide a method for fabricating a grid with a high line rate.

Another object of an embodiment of the present invention is to provide a method for fabricating a grid with uniform lines and spaces capable of absorbing less primary radiation than conventional grids and thus permitting a reduction in the x-radiation necessary to properly expose the photosensitive element.

Another object of an embodiment of the present invention is to provide a method of fabricating a grid that is focused to the source of the x-radiation and capable of improving image contrast.

Briefly, according to an embodiment of the present invention, a method for fabricating an anti-scatter x-ray grid for medical diagnostic radiography comprises providing a substrate having channels therein and including material that is substantially non-absorbent of x-radiation; and filling the channels with absorbing material that is substantially absorbent of x-radiation. In a preferred embodiment, the step of providing a substrate having channels therein comprises sawing a plastic substrate with a thin circular blade and the step of filling the channels with absorbing material comprises melting the absorbing material and flowing the melted absorbing material into the channels.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings, where like numerals represent like components, in which:

FIG. 3 is a front view of a cutting blade.

FIG. 4 is a sectional side view of the cutting blade of FIG. 3.

FIG. 5 is a partial perspective view of a channel through a non-absorbent substrate.

FIG. 5*a* is a sectional side view of another embodiment of a channel through a non-absorbent substrate.

FIG. 6 is a sectional side view of a substrate support surface which is rotatable for providing the desired angle of substrate channel.

DETAILED DESCRIPTION OF A PREFERRED EMBODIMENT OF THE INVENTION

Figure 1:
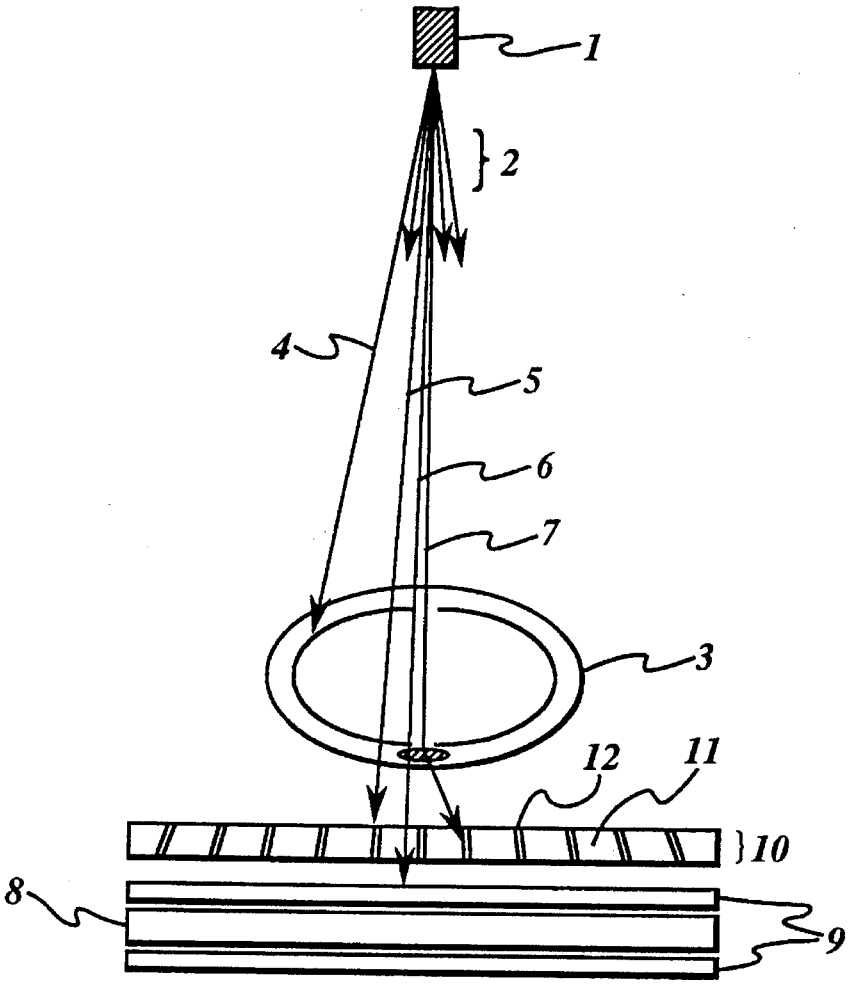
FIG. 1 is a sectional side view of a radiographic imaging arrangement.

FIG. I is a sectional side view of a radiographic imaging arrangement. A tube 1 generates and emits x-radiation 2 which travels toward a body 3. Some of the x-radiation 4 is absorbed by the body while some of the radiation penetrates and travels along paths 5 and 6 as primary radiation, and other radiation is deflected and travels along path 7 as scattered radiation.

Radiation from paths 5, 6, and 7 travels toward a photosensitive film 8 where it will become absorbed by intensifying screens 9 which are coated with a photosensitive material that fluoresces at a wavelength of visible light and thus exposes photosensitive film 8 (the radiograph) with the latent image.

When an anti-scatter grid 10 is interposed between body 3 and photosensitive film 8, radiation paths 5, 6, and 7 travel toward the anti-scatter grid 10 before film 8. Radiation path 6 travels through translucent material 11 of the grid, whereas both radiation paths 5 and 7 impinge upon absorbing material 12 and become absorbed. The absorption of radiation path 7 constitutes the elimination of the scattered radiation. The absorption of radiation path 5 constitutes the elimination of part of the primary radiation. Radiation path 6, the remainder of the primary radiation, travels toward the photosensitive film 8 and becomes absorbed by the intensifying photosensitive screens 9 that fluoresce at a wavelength of visible light and thus exposes photosensitive film 8 with the latent image.

Figure 2:
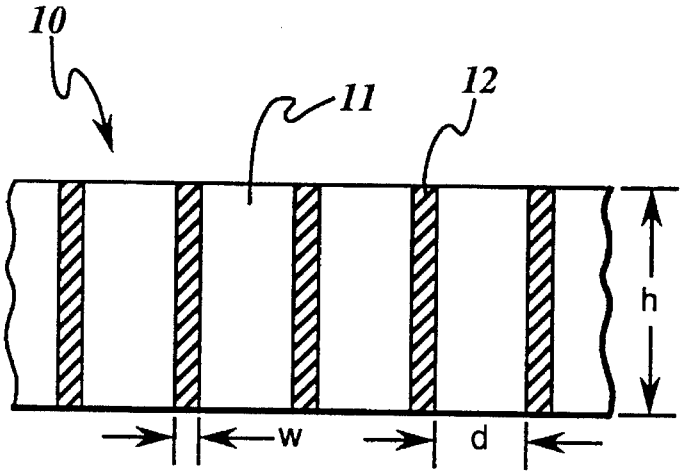
FIG. 2 is a sectional side view a portion of an anti-scatter x-ray grid.

FIG. 2 is a sectional side view a portion of an anti-scatter x-ray grid 10. As discussed above, an important parameter in the design is the grid ratio r, which is defined as the ratio between the height h of the x-ray absorbing strips 12 and the distance d between them. For medical diagnostic radiography the ratios generally range from 2:1 to 16:1. Another interdependent variable in the design parameters is the line rate of strips per centimeter. An absorbing strip must be thin enough to permit the total combined thicknesses of the strips and the distances between them to fit within a given centimeter and provide the predetermined line rate. Typically, line rates vary from 30 to 80 lines per centimeter and the absorbing strips have a width w along the sectional side view on the order of 15 to 50 μm. Using the present invention, higher line rates (up to about 300) can be achieved, and therefore image contrast can be improved.

FIGS. 3 and 4 are front and sectional side views respectively of a cutting blade 21. FIG. 5 is a partial perspective view of a channel through a substantially non-absorbent substrate. According to an embodiment of the present invention, an anti-scatter x-ray grid is fabricated by cutting the surface of a solid sheet of non-absorbent substrate material 11 to form the desired plurality of linear absorber channels of the desired dimensions. The substrate may comprise any substantially non-absorbent material having appropriate structural and thermal properties to withstand further processing and use. The words "substantially non-absorbent" mean that the substrate thickness and material are sufficient to prevent substantial attenuation of x-radiation such that at least 85% (and preferably at least 95%) of the x-radiation will pass through the substrate. In one embodiment the substrate comprises a plastic such as Ultem® polyetherimide (Ultem is a trademark of General Electric Co.). Other examples of appropriate substrate material include substantially non-absorbent polyimides, polycarbonates, other polymers, ceramics, woods, graphite, glass, metals, or composites thereof. The substrate may further include filler material such as particles or fibers including carbon, glass, or ceramic, for example, which can be useful to provide proper mechanical characteristics.

The substrate provides structural support for the grid, and plastic materials are particularly useful because they absorb less radiation than aluminum strips.

The saw may comprise a blade adapted to cut appropriately thin and deep channels in substrate 11. Examples of such saws 21 include saws of the type used in the semiconductor industry for dicing silicon wafers such as manufactured by Tokyo Seimitsu of Japan and Semitec of Santa Clara, Calif., for example. A thin blade portion 20 extends from a thicker inner portion 22 which is rotated about an axis 24. Preferably, the blade thickness ranges from about 15 to 70 μm so that these saws can provide desired line rates. In one embodiment the blade comprises a diamond-coated resin. Other materials appropriate for the saw blades include, for example, materials such as metals or resins having hard carbide coatings such as silicon or tungsten carbide.

Either a plurality of blades can be arranged side by side to cut the channels simultaneously or a single blade can cut each of the channels sequentially. If the blade is not of sufficient depth, then one fabrication technique is to turn the substrate over and cut on the opposite surface of the substrate to form a channel having two portions 26*a* and 26*b* such as shown in FIG. 5*a*.

Preferably, for ease of later fabrication, channels do not extend completely through the substrate. The channel configuration may be one of several types. In one embodiment, the channels are each perpendicular to the surface of the substrate. In another embodiment, some of the channels are at a predetermined angle to the surface to form a focused grid. Commercially available cutting saws typically cut perpendicular to flat substrates. If an angle is desired, the angle can be obtained, for example, as shown in the embodiment of FIG. 6, which is a sectional side view of a substrate support surface which is rotatable for providing the desired angle of substrate channel. Even if angled channels are not desired, a movable support table for use under the substrate such as available from Anorad Corporation of Hauppaugue, N.Y., is useful because blades for cutting semiconductor wafers are not always large enough (or do not always have enough range of motion) to create the desired length of channels.

The channels are not limited to the rectangular shapes obtainable with the above described cutting saw. The channels can alternatively be round or comprise other types of cavities and can be formed by any of a number of methods such as etching, molding, heat deforming and/or reforming, milling, drilling, or any combination thereof.

After the channels are formed, absorbing material 12, which is substantially absorbent, is applied to the channels. The words "substantially absorbent" mean that the thickness and material density are sufficient to cause substantial attenuation of x-radiation such that at least 90% (and preferably at least 95%) of the x-radiation will be absorbed. In one embodiment of the present invention, the channels are filled under vacuum conditions with an absorbing material that can be readily melt-flowed into the channels. In a preferred embodiment the absorbing material comprises a lead-bismuth alloy. Other substantially absorbent materials can include metals such as lead, bismuth, gold, barium, tungsten, platinum, mercury, thallium, indium, palladium, silicon, antimony, tin, zinc, and alloys thereof.

The substrate material and absorbing material must be chosen so that the substrate material is able to withstand the temperatures required for melting and flowing the absorbing material during the amount of time required for the fabrication process.

Figure 7:
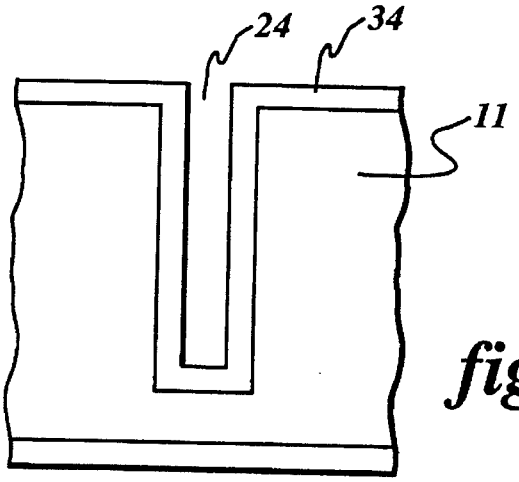
FIG. 7 is a sectional side view of a channel coated with adhesion promoting material.

FIG. 7 is a sectional side view of the channel 26 coated with an optional adhesion promoting material 34. To aid in the adhesion of the absorbing material, the adhesion promoting material can be formed on the channel surfaces. In one embodiment, copper is coated to a sufficient thickness to provide a substantially continuous coating on the channel surfaces. Other appropriate adhesion promoting materials include nickel and iron, for example. Any residual adhesion promoting material on an outer surface of the substrate can be removed either at this time or at a later time simultaneously with residual absorbing material.

Figure 8:
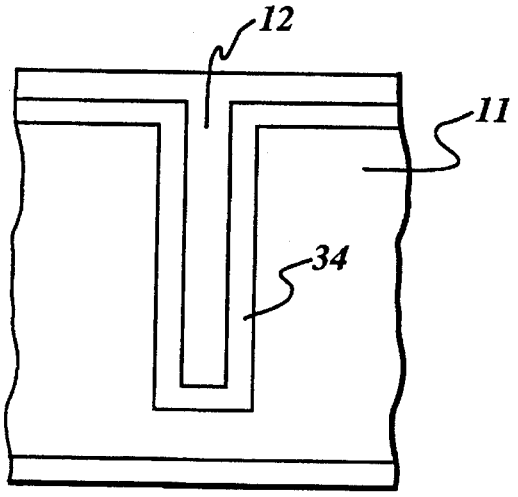
FIG. 8 is a view similar to that of FIG. 7 after the channel has further been filled with absorbing material.

FIG. 8 is a view similar to that of FIG. 7 after the channel has been filled with the absorbing material. An alloy commercially available from Belmont Metals of Brooklyn, N.Y., has a eutectic at 44% lead–56% bismuth with a melting point of 125° C. Ranges of 40% lead–60% bismuth through 50% lead–50% bismuth would also be advantageously close to the eutectic. This is the preferred filling material since it forms a low melting point eutectic and it has a mass absorption coefficient of 3.23 at 125 KeV, which is superior to that of pure lead (3.15 at 125 KeV). The use of a plastic non-absorbent substrate material with a lead-bismuth absorbing material is advantageous because the substrate remains stable at the low melting point of the absorbing material.

Any residual adhesion promoting material and/or non-absorbing material remaining on the outer surfaces of the substrate can be removed by a technique such as polishing, milling, or planing, for example.

Figure 9:
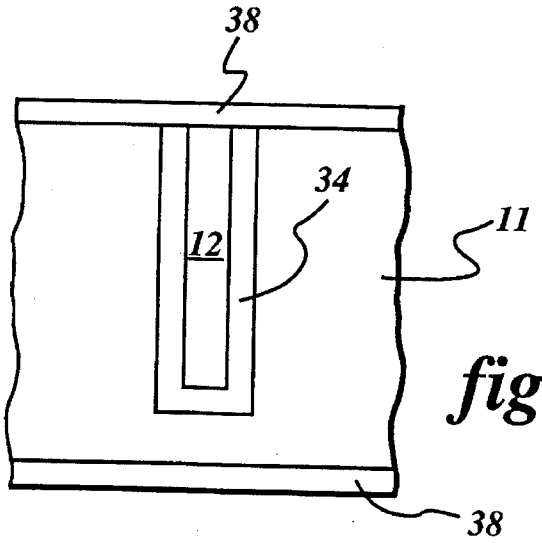
FIG. 9 is a view similar to that of FIG. 8 after the surfaces of the substrate and absorbing material are coated with a protective layer.

Any of a variety of finishing techniques such as polishing, painting, laminating, chemical grafting, spraying, gluing, or the like, may be employed if desired to clean or encase the grid to provide overall protection or aesthetic appeal to the grid. FIG. 9 is a view similar to that of FIG. 8 after the surfaces of the substrate and absorbing material are coated with a protective layer 38. The protective layer may comprise similar materials as those described with respect to the substrate. In one embodiment, protective layer 38 comprises a plastic such as polyetherimide. The protective layer comprises substantially non-absorbent material and helps to protect the substrate and absorbing material surfaces from scratches. Furthermore, the protective layer is useful for safety concerns when the absorbing material includes a metal such as lead.

EXAMPLE

A grid prototype of a substrate comprising Ultem polyetherimide 1000 was made using a precision dicing saw where a 10×10×0.5 cm sample was cut on one face to produce channels in the surface that had a width w of 50 μm, a height h of 600 μm and a length l of 10 cm (w, h, and l shown in FIG. 5), and such that the line rate was 67 lines/cm, the lines being equally spaced to give a grid ratio of 6:1.

The substrate was then vacuum filled with the 44% lead–56% bismuth alloy at 140° C. by immersing the substrate into the molten metal and subjecting it to a pressure of less than 10 Torr. The substrate was removed and allowed to cool to ambient temperature and was then polished smooth to remove any excess or stray metal. The device was examined microscopically, and the channels were found to be completely and uniformly filled.

The device of the present invention is reworkable in that the absorbing material which is not completely or properly flowed in the channels can be removed by heating the assembly and reflowing the absorbing material. Furthermore, this feature can be used to reclaim (remove) the absorbing material before later disposal of any grids. This removal capability is advantageous, especially in situations where lead may cause a safety-related concern and in situations where recycling of the substrate material is desired.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method for fabricating an anti-scatter x-ray grid for medical diagnostic radiography, the method comprising:

providing a substrate having channels therein, the substrate comprising a plastic material that is substantially non-absorbent of x-radiation; and melting absorbing material that is substantially absorbent of x-radiation and flowing the melted absorbing material into the channels, the substrate comprising material capable of remaining stable at the melting temperature of the absorbing material.

2. The method of claim 1, wherein the step of providing a substrate having channels therein is a technique selected from the group consisting of molding, drilling, and cutting of a substrate.

3. The method of claim 1, wherein the step of providing a substrate having channels therein comprises sawing a substrate with a thin circular blade.

4. The method of claim 3, wherein the step of sawing comprises sawing a single surface of the substrate.

5. The method of claim 3, wherein the step of sawing comprises sawing two surfaces of the substrate.

6. The method of claim 1, further including, after flowing the melted absorbing material into the channels, polishing at least one surface of the substrate.

7. The method of claim 1, further including the step of, prior to flowing the melted absorbing material into the channels, coating the surfaces of the channels with adhesion promoting material.

8. The method of claim 1, wherein the absorbing material comprises a metal alloy.

9. The method of claim 1, wherein the absorbing material comprises a lead-bismuth alloy.

10. The method of claim 1, wherein the step of providing a substrate having channels therein comprises providing at least some angled channels.

11. The method of claim 10, wherein the step of providing at least some angled channels includes situating the substrate on a rotatable support surface.

12. The method of claim 1, further including, after flowing the melted absorbing material into the channels, the step of applying a protective layer over at least one surface of the substrate, the protective layer comprising material that is substantially non-absorbent of x-radiation.

13. The method of claim 8, wherein the metal alloy comprises material selected from the group consisting of lead, bismuth, gold, barium, tungsten, platinum, mercury, thallium, indium, palladium, silicon, antimony, tin, and zinc.

14. A method for fabricating an anti-scatter x-ray grid for medical diagnostic radiography, the method comprising:

sawing channels in a substrate with a thin circular blade, the substrate comprising a plastic material that is substantially non-absorbent of x-radiation; and melting absorbing material comprising a metal alloy that is substantially absorbent of x-radiation and flowing the melted absorbing material into the channels, the substrate comprising material capable of remaining stable at the melting temperature of the absorbing material.

15. The method of claim 14, wherein the absorbing material comprises a lead-bismuth alloy.

16. The method of claim 14, wherein the step of sawing channels therein comprises sawing at least some angled channels.

17. The method of claim 16, wherein the step of sawing at least some angled channels includes situating the substrate on a rotatable support surface.

* * * * *